US005528838A

United States Patent [19]

Timm et al.

[11] Patent Number: 5,528,838

[45] Date of Patent: Jun. 25, 1996

[54] INSULATED DRYER DRUM

[75] Inventors: Gerald L. Timm, Schoolcraft; John H. Peter, Three Rivers, both of Mich.

[73] Assignee: The Johnson Corporation, Three Rivers, Mich.

[21] Appl. No.: 217,711

[22] Filed: Mar. 25, 1994

[51] Int. Cl.[6] ..... D06F 58/00; F26B 11/02; F28D 11/02; F28F 5/02

[52] U.S. Cl. ..... 34/124; 34/125; 165/89

[58] Field of Search ..... 34/110, 123, 124, 34/125; 162/207, 375; 165/89; 492/52, 55, 56

[56] References Cited

U.S. PATENT DOCUMENTS

| | | | |
|---|---|---|---|
| 3,065,552 | 11/1962 | Skinner | 34/124 |
| 4,192,080 | 3/1980 | Irpola | 34/41 |
| 4,520,578 | 6/1985 | Schiel et al. | 34/110 |
| 4,542,593 | 9/1985 | Viitanen et al. | 34/124 |
| 4,639,291 | 1/1987 | Ota et al. | 162/207 |
| 4,639,292 | 1/1987 | Ota et al. | 162/375 |
| 4,888,095 | 12/1989 | Gulya et al. | 34/110 |

*Primary Examiner*—John M. Sollecito
*Assistant Examiner*—Steve Gravin
*Attorney, Agent, or Firm*—Beaman & Beaman

[57] ABSTRACT

The invention pertains to apparatus for thermally insulating selected portions of a cylindrical dryer drum, usually adjacent the drum ends, for the purpose of obtaining a substantially uniform drum shell temperature throughout its length to obtain a uniform moisture profile throughout the width of the web being dried. A plurality of cylindrical segments are bolted together within the drum interior to define a circumferential assembly biased against the drum inner surface. The segments each include a thermal insulation material engaging the drum shell preventing direct access of that engaged portion of the shell with the steam within the drum thereby reducing the exterior temperature of the drum shell at the location of the thermally insulated segment. The segments may be bolted together, widthwise, to increase the axial dimension of the temperature controlling segment assembly.

5 Claims, 2 Drawing Sheets

INSULATED DRYER DRUM

BACKGROUND OF THE INVENTION

1. Field of the Invention

The invention pertains to apparatus for controlling the temperature of a rotating dryer drum along its axial dimension by internally insulating a portion of the dryer drum from direct engagement by the steam within the drum.

2. Description of the Related Art

Rotating dryer drums are commonly used to heat webs of material, such as paper or fabric, for the purpose of drying the web. For instance, in the manufacture of paper, the web is passed over the outer periphery of a number of rapidly rotating steel drums internally heated by the injection of steam therein. As the paper engages the periphery of the hot drum, moisture is removed from the web, and by using a plurality of rapidly rotating drums high production of properly dried paper is achieved.

It is very important in the drying of paper webs that the extent of drying be closely controlled so the paper will have the proper moisture profile throughout the web width and meet the maximum and minimum moisture content specifications. Of course, the moisture content of the paper passing over the rolls must be uniform throughout the width of the web. Difficulty is often encountered in maintaining a uniform moisture content in the paper web throughout its width in that difficulty is encountered in maintaining a uniform temperature of a drying drum shell throughout its axial length.

The temperature of a dryer drum will often considerably vary throughout its length for several reasons. For instance, the uneven buildup of water condensate within the drum adversely affects its heat transfer ability, and syphon systems are located in the drum to control and remove the condensate. Also, there is a common tendency for the temperature of the dryer drums to be hotter adjacent the drum ends due to the fact that the amount of paper engaging the drum adjacent its ends will be less than the paper mass engaging the central portion of the drum and the rate of heat transfer will be less, and the presence of the drum head or end adjacent the ends of the drum shell often tend to maintain the ends of the drum at a higher temperature due to the effect of the greater heated mass of drum material adjacent the drum shell ends. Accordingly, it is common practice when drying paper webs to only use the central portion of the dryer drum shell resulting in inefficient use of the drum, requiring drums much wider than the web and restricting the width of the paper web being dried.

Various attempts have been made to overcome the above problem by reducing the temperature of the dryer drum adjacent the ends of the drum shell. Such attempts include the application of an insulating material on the exterior of the drum adjacent the drum ends whereby the amount of heat transferred to the web being dried adjacent the ends is reduced and the moisture profile within the paper web is controlled. Such modification of drying drums may include the wrapping of fabric or foil adjacent the drum ends as shown in U.S. Pat. Nos. 4,192,080; 4,639,291 and 4,639,292. However, the insulating of the exterior of the drum in the manner shown in these patents has the disadvantage of locating the temperature controlling apparatus on the drum exterior in direct contact with the paper web, and the insulation material is subject to wear, thinning and maintenance problems, and may also contaminate the web being dried if pieces thereof cling to the web.

3. Objects of the Invention

It is an object of the invention to provide drum shell temperature controlling apparatus for use with a rotating dryer drum wherein the apparatus is completely internally mounted within the drum and is not subject to damage or wear by the material being dried.

Another object of the invention is to provide temperature controlling apparatus for modifying the temperature of a rotating dryer drum shell along its length wherein such drum temperature control is achieved by insulating selective portions of the drum shell interior with respect to the heated medium, i.e. steam, within the drum, wherein the portion of the dryer drum engaged by the temperature controlling apparatus will be at a reduced temperature as compared to the interior portion of the drum directly exposed to the steam.

A further object of the invention is to provide internally mounted temperature control apparatus for a rotating heated dryer drum which permits a circumferential portion of the dryer drum shell to be maintained at a lower temperature than other drum shell portions wherein the temperature regulation occurs throughout the drum circumference at the desired location.

Yet an additional object of the invention is to provide internally mounted dryer drum temperature control apparatus which consists of a plurality of segments which may be readily inserted through the drum access port and assembled within the drum, and the assembly includes a plurality of segments selectively interconnectable to permit the desired axial width of insulation required, and also, by the use of a plurality of insulating segments of various lengths the apparatus may be readily accommodated to a variety of dryer drum diameters.

SUMMARY OF THE INVENTION

Insulation of selected circumferential portions of a dryer drum shell, usually circumferential portions adjacent the dryer drum ends, is achieved by assembling a plurality of thermal insulating segments within the dryer drum. Each of the segments includes a cylindrical configuration plate surface having a thermal insulation material mounted thereon, and the segments are assembled in an end-to-end relationship to define a closed circumferential assembly within the drum.

The segments are each provided with fasteners adjacent their ends whereby adjacent segments are connected to each other end-to-end to form the desired closed assembly. The fasteners preferably include compression springs whereby the segments are biased away from each other, within limits, to slightly vary the diameter of the assembly, and in this manner the compression springs firmly hold the segments and the thermal material mounted thereon firmly against the inner diameter of the dryer drum shell. However, the segment fasteners may be formed only by bolts whereby the adjustment of threaded fasteners may be used to expand the diameter of the assembly. The firm interconnection between the insulator assembly and the dryer drum shell produces a frictional engagement and mechanical modification to the drum shell is not required.

If desired, an insulated angle plate may be mounted adjacent a lateral side of selected segments for engaging the drum end head to reduce the rate of heat transfer thereto.

It is preferred that a mounting flange be mounted upon one of the lateral sides of the segments substantially perpendicular to the configuration thereof having fastener receiving holes whereby insulated segments mounted in a side-by-side relationship may be bolted together to define a completed assembly having a greater axial width than that provided by a single series of thermal insulated segments bolted in end-to-end relationship. As the width of the segments is limited by the dimension of the drum access port, the ability to interconnect the segments in side-by-side relationships permits the assembly to have the axial width often required.

As the apparatus of the invention is completely mounted within the drum interior, no wear or deterioration occurs to the web being dried during use, and drum temperature control apparatus in accord with the invention will provide long dependable use, as is required with dryer drum installations, such as paper mills.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
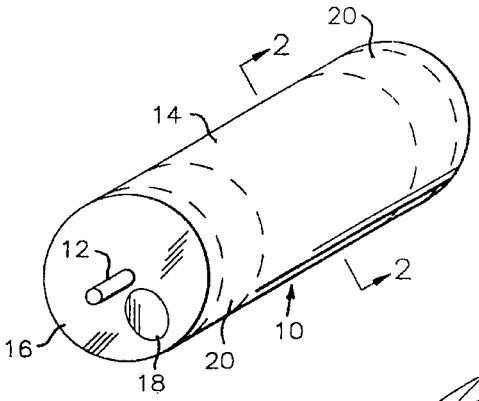
FIG. 1 is a perspective view of a typical dryer drum using the concepts of the invention.

A typical dryer drum with which the invention is used is shown in FIG. 1 wherein the dryer drum is generally indicated at 10. The drum is rotatably mounted upon an axle 12 which is supported within conventional bearings, not shown, and the drum includes a cylindrical shell 14 closed at its ends by circular end head plates 16, the axle 12 being mounted within the end plates. Access to the interior of the drum 10 is through a typical port 18 formed in one of the end plates 16, and usually, the port 18 will have a maximum dimension of about fifteen inches. A cover normally seals the port 18.

Figure 2:
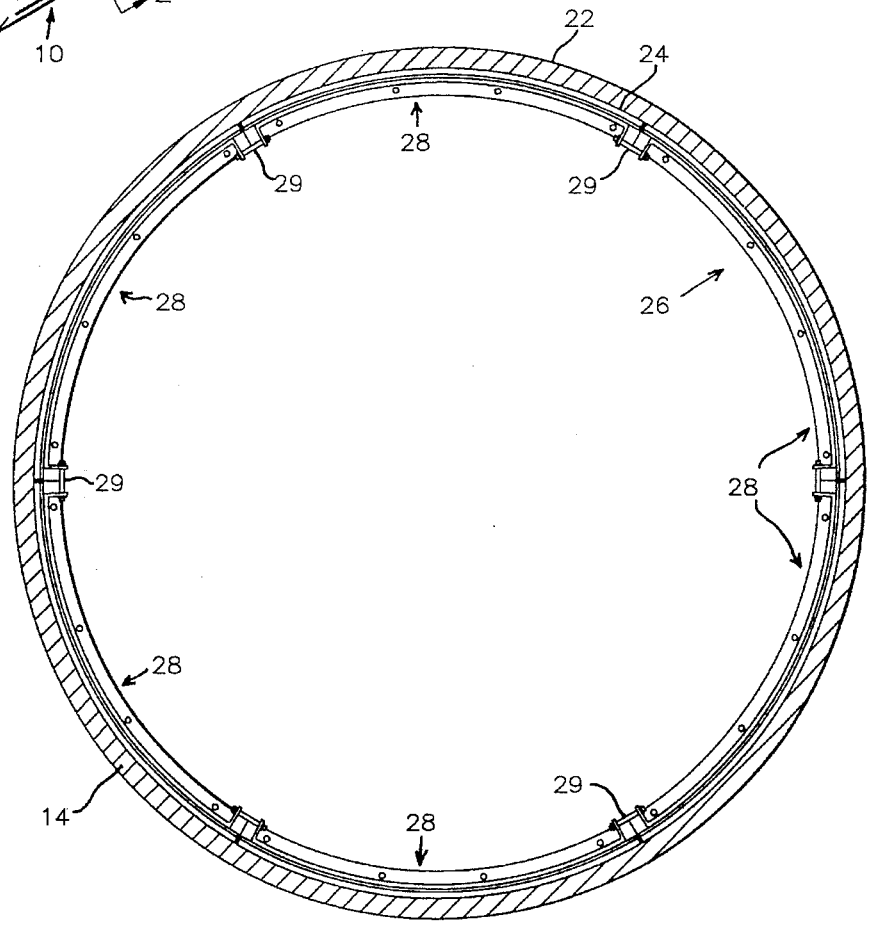
FIG. 2 is a diametrical section through a dryer drum utilizing the invention as taken along Section 2—2 of FIG. 1.

In FIG. 1, the portions of the shell 14 in which it is desired to reduce the temperature is indicated at 20 between the dotted lines, and as will be appreciated the insulated portions 20 are located adjacent the ends of the shell wherein the highest temperatures usually occur. With reference to FIG. 2, the shell outer surface 22 will be concentric to the axis of drum rotation, and the drum shell inner surface is illustrated at 24. The drum inner surface 24 is, likewise, concentric to the drum axis of rotation, and the thickness of the drum shell is exaggerated in FIG. 2 for purpose of illustration.

The invention consists of an assembly 26 which is located within the shell 14 engaging the shell inner surface 24. The assembly 26 is formed of a plurality of circumferential extending segments 28, and the adjacent segments 28 are interconnected in an end-to-end relationship by fasteners 29, as is described below.

Figure 3:
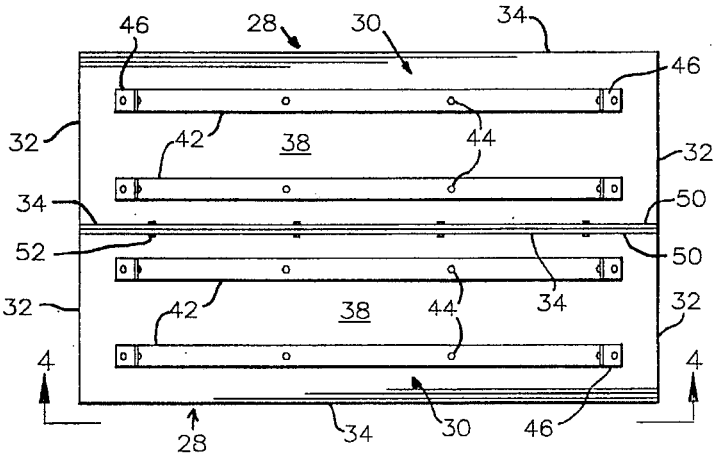
FIG. 3 is a plan view of a pair of thermal insulating segments in accord with the invention as mounted in a side-by-side relationship, and prior to being assembled to other segments in an end-to-end assembly.
Figure 4:
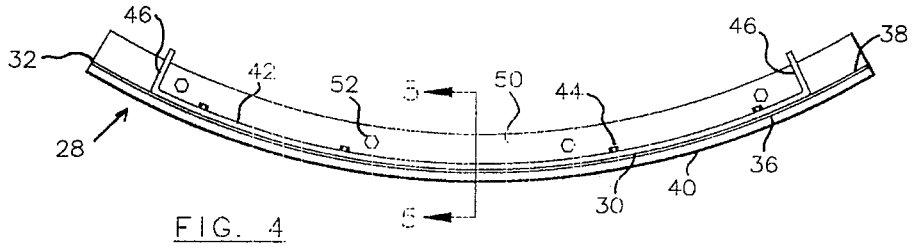
FIG. 4 is a side elevational view of FIG. 3 as taken along Section 4—4 thereof.
Figure 5:
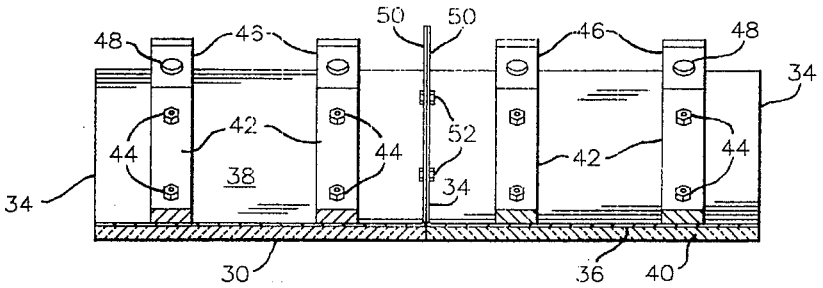
FIG. 5 is a sectional view of FIG. 4 as taken along Section 5—5 thereof.

In FIG. 3, a typical assembly of a pair of segments 28 mounted in a side-by-side relationship is illustrated. In most cases, the assembly 26 will consist of a pair of segments 28 mounted in a side-by-side relationship in order to achieve the desired width of insulation within the drum 10, and as the segments 28 shown in FIGS. 3–5 are identical, the description of one segment suffices for identical segments. It is to be understood, however, that if a narrow width assembly 26 is desired only single segments 28 connected in end-to-end relationship would be used.

Each of the segments 28 includes a thin plate 30 in the order of 0.060 inches which, when viewed as in FIG. 3, is of a generally rectangular configuration. The segment length is defined by ends 32 perpendicularly related to the length of the plate 30, while the width of the plate 30 is defined by the parallel lateral sides 34.

Each segment plate 30 includes a cylindrical portion convex outer surface 36, FIG. 5, which is cylindrical in its form between ends 32, and the radius of the outer surface 36 is substantially identical to the radius of the drum shell inner surface 24. The segments inner surface 38 is also of a cylindrical configuration and is of a concave form. As will be appreciated from FIG. 5, the configuration of the segment surface 36 in a transverse direction between the plate lateral sides 34 is flat so as to correspond to the axial shape of the drum shell inner surface 24.

A thermal insulating material 40 is affixed to the segment outer surface 36 throughout the plate configuration. While there are a variety of thermal insulating materials which may be suitable in the practice of the invention, it is preferred that the insulated material 40 consist of a synthetic fabric or foam that is very porous and is able to absorb at least four times its weight in steam condensate.

Figure 8:
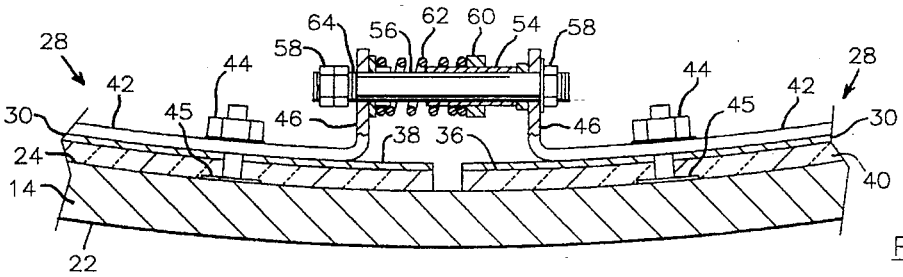
FIG. 8 is an enlarged detail side elevational sectional view, partially sectioned, taken through the drum and the ends of assembled segments, illustrating the details of the fasteners.

On each segment 28, a pair of identical parallel support bars 42 are mounted upon the plate inner surface 38 by nuts and bolts 44, FIG. 8. The bolts 44 extend through holes in the plate 30 and through insulation 40 and the support bars 42 and the bolt heads 45 are thin and engage the insulation material 40 and in this manner the support bars are firmly attached to the plate 30 reinforcing the plate and as the support bars are of the same cylindrical segment configuration as the plate 30, the support bars aid the plate in maintaining its desired configuration. Simultaneously, the bolt heads 45 will maintain insulation material 40 firmly in engagement with the plate 30.

Each of the support bars includes a deformed end 46 which is bent inwardly so as to extend away from the associated plate 30. A hole 48 is formed in each of the support bar ends 46 for receiving the fasteners 29 as described below.

As it is usually desirable to assemble two segments 28 in a side-by-side relationship to achieve the desired axial width of the assembly 26, a sheet metal flange 50 is welded to a lateral side 34 of the plate 30. This flange 50 is perpendicularly related to the general configuration of the associated segment and plate, as will be appreciated from FIG. 5, and holes are formed in the flanges 50 whereby contiguous flanges 50 of segments 28 may be bolted together by nut and bolt assemblies 52 as will be appreciated from FIGS. 3–5. Usually, four nuts and bolts are sufficient to interconnect each pair of segments 28.

The fasteners 29 are best shown in detail in FIG. 8. A hollow threaded bolt 54 is mounted between support bar ends 46, and an inner threaded bolt 56 extends through the hollow bolt 54 and support bar end holes 48 and is provided with nuts 58 at each end whereby the inner bolt 56 will prevent excessive separation between the opposed support bar ends 46. A nut 60 is threaded upon the hollow bolt 54, and a compression spring 62 is interposed between the nut 60 and the opposed support bar end 46. The inner bolt nuts 58 are located upon the inner bolt such that a clearance 64, FIG. 8, will exist between the nuts 58 and the support bar ends, and in this manner, the spring 62 will impose a biasing force on interconnected segments 28 tending to separate the segments, while the inner bolt 56 prevents excessive segment separation.

Installation of the assembly 26 within the drum 10 is as follows. The installer will remove the cover from the port 18, and the components of the assembly 26 may be inserted through the port 18 piece by piece to the installer located within the drum. The width of the segments 28 is usually only slightly less than the maximum dimension of the port 18, and usually, it is desired that the portions 20 of the drum 10 to be insulated be in the order of approximately thirty inches, and hence, a pair of segments 28 are bolted together in side-by-side relationship. However, it will be appreciated that if only fifteen inches or less of the drum shell is to be insulated, only a single row of segments 28 need be used, and such segments would not require the presence of the flange 50.

Assuming that a pair of segments 28 are to be mounted in side-by-side relationship, two of the segments 28 will be positioned as shown in FIG. 3 wherein the flanges 50 will engage, and upon alignment of the flange holes the nut and bolt assemblies 52 may be inserted through the flange holes to assemble two of the segments in the relationship shown in FIG. 3. After the necessary number of pairs of segments 28 are assembled, six in the disclosed embodiment shown in FIG. 2, the interconnected pairs of segments may be preliminarily aligned in an end-to-end relationship and the fasteners 29 inserted into the support bar holes 48 as described above. The fastener nuts 60 will be backed off to relieve any biasing force or compression imposed upon the support bars by the spring 62, but the inner bolts 56 will maintain the preliminary assembly of the segments 28 of the assembly 26. Once the assembly 26 is properly located within the drum 10, the fastener nuts 60 will be rotated to compress the springs 62, and the outward biasing force imposed on the assembly 26 by the springs 62 will cause the insulated material 40 to be firmly forced against the drum shell inner surface 24 producing a firm frictional mechanical connection between the assembly 26 and the drum 10.

Upon completion of the installation of the insulator assembly 26 within the drum 10, it will be appreciated that the direct engagement of the insulating material 40 with the shell inner surface 24 will prevent the direct transfer of heat from the steam within the drum 10 to that portion of the shell 14 in alignment with and engaged by the assembly 26, and that portion of the shell 14, as indicated by the insulated portions 20 of FIG. 1, will be at a reduced temperature as compared to the temperature in the shell between the insulated portions. In this manner, the temperature in the drum shell can be regulated along its length to produce the desired moisture profile within the web being dried as it engages the shell outer surface 22. The firm mounting of the assembly 26 within the drum 10 will assure a long, trouble-free life of the apparatus of the invention, and as the assembly 26 is completely located within the drum 10, wear and deterioration is minimized in that the insulating assembly 26 does not come into contact with the web being dried.

Figure 6:
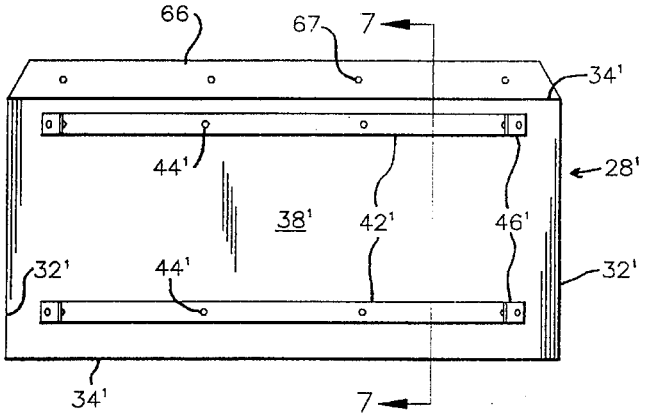
FIG. 6 is a top plan view of an insulated segment using a side angle plate.
Figure 7:
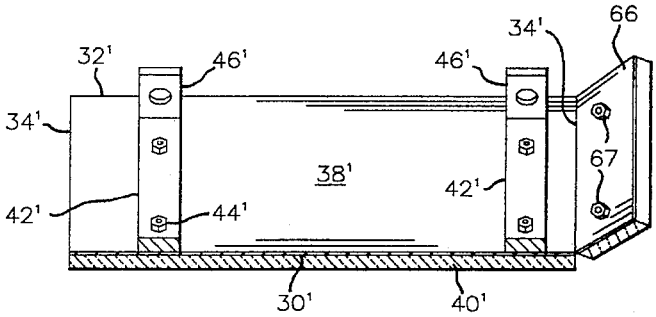
FIG. 7 is an elevational sectional view taken along Section 7—7 of FIG. 6.

FIGS. 6 and 7 disclose a variation of an insulated segment 28 that may be used, if desired, and in this embodiment components identical to those previously described are indicated by primed reference numerals.

In the embodiment of FIGS. 6 and 7, a portion adjacent a lateral edge 34' is welded to the edge 34' to define an angle plate 66 which extends inwardly with respect to that portion of the plate 30' located between the support bars 42'. The insulation material on the plate 66 is held in place by bolts 67. This angular orientation of the angle plate 66 permits the plate 66 to be placed against a drum end plate 16 to insulate that portion of the end plate 16 adjacent the shell 14, and reduce the likelihood of heat being transferred to the shell 14 through the end plate 16. Use of a segment 28' such as shown in FIGS. 6 and 7 will depend upon the particular operating characteristics and temperatures of the drum in which temperature control is desired.

It is appreciated that various modifications to the inventive concepts may be apparent to those skilled in the art without departing from the spirit and scope of the invention. For instance, the fasteners 29 need not utilize a compression spring. If the nuts 58 are located on the opposite sides of the support bar ends 46 as shown in FIG. 8, the nuts 58 can be used to separate the adjacent ends 46 to increase the diameter of the assembly, and the insulation material will be forced against the shell inner wall 24 as the assembly diameter is expanded.

We claim:

1. Apparatus for thermally insulating a circumferential portion of an internally heated dryer drum having an interior, an axis and a cylindrical inner surface defined by a radius comprising, in combination, a plurality of arcuate segments each having an area formed by a length defined by first and second ends, a width defined by first and second lateral sides, and having an outer cylindrical convex segment surface configuration defined between said ends having a radius substantially equal to the drum inner surface radius and a planar transverse configuration between said lateral sides, a thermal insulating material defined on each segment outer surface substantially throughout its area, and fasteners defined on each segment adjacent its ends permitting a plurality of segments to be interconnected in end-to-end relationship within the dryer drum defining a closed cylindrical circumferential assembly held in close firm engagement with the dryer drum inner surface to thermally insulate that portion of the drum inner surface engaged by said segments, said segments each including a plate defining said ends and lateral sides, each plate having a convex outer surface adapted to be disposed toward the dryer drum inner surface and a concave inner surface adapted to be disposed toward the drum interior, said thermal insulating material being defined upon said plate outer surface and said fasteners being mounted on said plate inner surface, said fasteners including compression springs imposing an expanding biasing force on interconnected segments in the circumferential direction of the length of said segments to outwardly bias said assembly of interconnected segments to expand the circumferential dimension of said assembly and maintain said segments in firm engagement with the dryer drum inner surface.

2. Apparatus for thermally insulating a circumferential portion of an internally heated dryer drum as in claim 1, said thermal insulating material comprising a synthetic fabric capable of absorbing at least four times its weight in condensate.

3. Apparatus for thermally insulating a circumferential portion of an internally heated dryer drum as in claim 2, at least one support bar mounted upon said plate inner surface extending in the direction of the length of the associated segment, said support bar having terminating ends located adjacent the segment ends, said support bar terminating ends extending away from the associated segment plate, said fasteners being mounted on said support bar terminating ends.

4. Apparatus for thermally insulating a circumferential portion of an internally heated dryer drum as in claim 1, said segment including an angle portion extending from one of said segment's lateral sides, said angle portion extending the length of the associated segment and angularly related to the transverse planar segment configuration and adapted to engage dryer drum end head structure.

5. Apparatus for thermally insulating a circumferential portion of an internally heated dryer drum as in claim 2, an inner flange substantially perpendicularly defined on said plate at one of said segment lateral sides extending away from the plate concave inner side wherein a pair of segments may be assembled in side-by-side relationship with their flanges engaging to increase the axial width of said assembly, and fasteners interconnecting engaging flanges.

* * * * *